United States Patent [19]

Cohen

[11] 4,017,944

[45] Apr. 19, 1977

[54] SHOULDER BAG CLASP

[76] Inventor: Hilda Cohen, 1010 Autumn Ave., Brooklyn, N.Y. 11208

[22] Filed: Mar. 14, 1975

[21] Appl. No.: 558,267

[52] U.S. Cl. ..... 24/86 R; 24/241 P; 24/73 LF

[51] Int. Cl.[2] ..... A44B 9/00; A44B 13/00

[58] Field of Search ..... 24/3 A, 259 A, 73 LF, 24/86 R, 241 P, 76, 4; 224/5 P

[56] References Cited

UNITED STATES PATENTS

| | | | |
|---|---|---|---|
| 359,365 | 3/1887 | Sink | 24/86 R |
| 1,015,143 | 1/1912 | Dallas | 24/86 R |
| 1,037,381 | 9/1912 | Wennerstrom | 224/5 P |
| 1,510,944 | 10/1924 | Lassen | 24/73 LF |
| 1,607,921 | 10/1926 | Schleimer | 24/73 LF |
| 1,695,521 | 12/1928 | Bemm | 24/73 LF |
| 1,877,702 | 9/1932 | St. Clair | 24/241 P |
| 2,533,780 | 12/1950 | Eutzler | 24/86 R |

FOREIGN PATENTS OR APPLICATIONS

| | | | |
|---|---|---|---|
| 171,538 | 11/1921 | United Kingdom | 24/241 P |

*Primary Examiner*—Bernard A. Gelak

[57] ABSTRACT

A shoulder bag clasp is used to hold and maintain a strap of a shoulder bag in a fixed position on the shoulder portion of a user's garment. The clasp comprises a rectangular shape member, bottom base, an upward extending end flange, and a shorter rectangular shaped member communicating perpendicularly with the upper end of the flange, wherein the shorter rectangular shaped member extends inward over the bottom base member. A stop member is hingably joined to the free end of the shorter rectangular shaped member, wherein the stop member can be rotated downward into a vertical position. The strap of the shoulder bag is contained in the opening defined by the bottom base, the flange, the shorter rectangular shaped member and the vertical stop member. A mechanism is provided for securing the bottom base member of the clasp flatwise to the shoulder portion of the garment.

2 Claims, 6 Drawing Figures

SHOULDER BAG CLASP

My invention relates to a unique and novel device for maintaining the shoulder strap of a shoulder bag in a fixed position on a shoulder portion of a user's garment.

It is known from U.S. Pat. Nos. 296,002; 1,027,527; 1,037,381; and 2,663,875 that bag holding devices have been empolyed, but these aformentioned patents are non-applicable to my present invention.

An object of my present invention is to provide a clasp for holding the shoulder strap of a shoulder bag on the shoulder portion of a user's garment.

A further object of my present invention is to provide a means for detachably securing the clasp to the shoulder portion of the user's garment.

A still further object is to provide a clasp for the strap of a shoulder bag that functions as an anti-theft device.

Another object of my present invention is to provide a clasp of simple design and relatively low manufacturing cost.

Briefly, my present invention comprises a shoulder bag clasp used to hold and maintain a strap of a shoulder bag in a fixed position on the shoulder portion of a user's garment. The clasp comprises a rectangular shape member, bottom base, an upward extending end flange, and a shorter rectangular shaped member communicating perpendicularly with the upper end of the flange, wherein the shorter rectangular shaped member extends inward over the bottom base member. A stop member is hingably joined to the free end of the shorter rectangular shaped member, wherein the stop member can be rotated downward into vertical position. The strap of the shoulder bag is contained in the opening defined by the bottom base, the flange, the shorter rectangular shaped member and the vertical stop member. A mechanism is provided for securing the bottom base member of the clasp flatwise to the shoulder portion of the garment.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
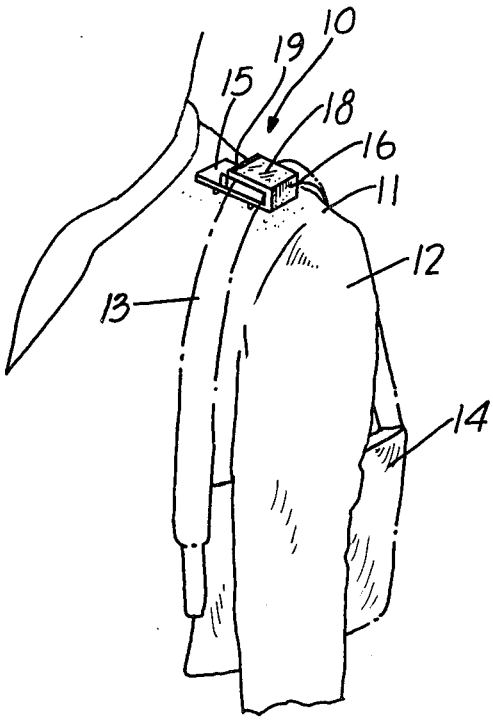
FIG. 1 illustrates a front view of the shoulder bag clasp in use.

Turning now descriptively to the drawings, in which similar reference characters denote similar elements throughout the several views, FIG. 1 shows an anti-theft, shoulder bag clasp 10 detachably mounted flatwise to a shoulder portion 11 of a user's garment 12, wherein the clasp 10 retains the strap 13 of a shoulder bag 14 in position.

Figure 3:
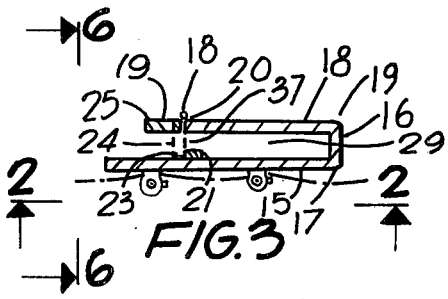
FIG. 3 illustrates a front view of the shoulder bag clasp.
Figure 6:
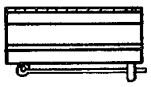
FIG. 6 illustrates an end view of the shoulder bag clasp.

FIGS. 3, 6 show the shoulder bag clamp 10 consisting of an elongated rectangular shaped base member 15, wherein an upward extending flange 16 communicates perpendicularly with the right end 17 of member 15. A shorter elongated rectangular shaped member 18 communicates perpendicularly with an upper end 19 of flange 16, wherein member 18 extends inward over member 15. A vertical space 37 between a free left end 20 of member 18 and a top face 22 of member 15 is closed by a movable rectangular shaped stop member 19 joined to the free left end 20 of member 18 by a hinge assembly 20, wherein member 19 is iron or steel. A magnet 21 is affixed to the top face 22 of member 15 wherein the outer edge 23 of magnet 21 is vertically aligned with the free inner end 20 of member 18. When member 19 is rotated downward into a vertical position as shown by phantom lines 24, the free left end 25 of member 19 engages the top face 22 of member 15 as member 19 also engages magnet 21. Members 15, 18, 19 and flange 16 describe an interior rectangular shaped opening 29. The shoulder strap 13 is slipped into opening 29, while member 19 is in a horizontal position. Member 19 is rotated downward into a horizontal position and held in place by the magnetic attraction of magnet 21.

Figure 2:
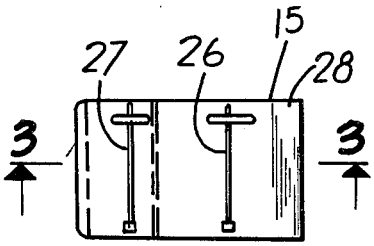
FIG. 2 illustrates a bottom view of the shoulder bag clasp.

FIG. 2 shows a pair of transversely placed safety pin members 26, 27 affixed to the bottom face 28 of member 15. Members 26, 27 secure the clasp 10 to the shoulder portion 11 of the garment 12.

Figure 4:
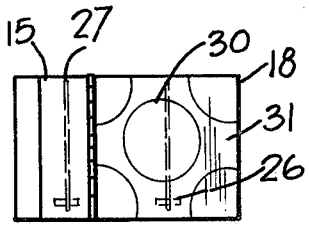
FIG. 4 illustrates a top view of the shoulder bag clasp.

FIG. 4 shows a design 30 imprinted on the top face 31 of member 18.

Figure 5:
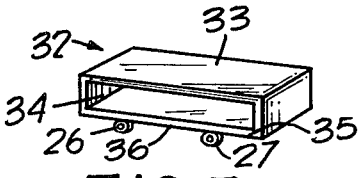
FIG. 5 illustrates a front perspective view of a second type of shoulder bag clasp.

FIG. 5 shows a second type 32 of shoulder bag clasp 10 consisting of a rectangular shaped frame 33 having an opening 34 therethrough. A pair of safety pin members 26, 27 are transversely affixed to the bottom face 35 of the bottom base 36 of frame 33.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A shoulder bag clasp, which comprises:

a. a rectangularly shaped bottom base member;

b. an upwardly extending flange communicating perpendicularly with a right end of said base member;

c. a shorter rectangularly shaped member communicating perpendicularly with an upper end of said flange, said shorter rectangularly shaped member extends inwardly over said base member, said flange, said base member, and said shorter rectangularly shaped member describing an opening therethrough;

d. means for securing said clasp to a shoulder portion of a garment, a strap of a shoulder bag adapted to be received in said opening, said securing means including a pair of saftey pin members affixed transversely to a bottom face of said rectangularly shaped bottom base member;

e. a rectangularly shaped stop member;

f. a hinge assembly joining said rectangularly shaped stop member to a left end of said shorter rectangularly shaped member, said rectangularly shaped stop member of sufficient length to engage a top face of said rectangularly shaped bottom base member, when said rectangularly shaped stop member extends vertically downward; and g. means for maintaining said stop member in a vertical downward position.

2. A shoulder bag clasp according to claim 1 wherein said means for maintaining includes a magnet affixed to said top face of said bottom base member, said stop member formed from a magnetic substance, said stop member magnetically attracted to said stop member.

* * * * *